US005699737A

United States Patent [19]

Hummel et al.

[11] Patent Number: 5,699,737

[45] Date of Patent: Dec. 23, 1997

[54] DEVICE FOR THE THROW-ON AND THROW-OFF OF ROLLERS

[75] Inventors: Peter Hummel, Offenbach am Main; Robert Ortner, Alzenau, both of Germany

[73] Assignee: MAN Roland Druckmaschinen AG, Germany

[21] Appl. No.: 640,615

[22] Filed: May 2, 1996

[30] Foreign Application Priority Data

May 3, 1995 [DE] Germany ..... 195 15 726.5

[51] Int. Cl.[6] ..... B41F 13/24; B30B 3/04

[52] U.S. Cl. ..... 101/247; 101/352; 101/185; 100/170

[58] Field of Search ..... 101/352, 247, 101/351, 139, 140, 143, 144, 145, 182, 184, 185; 100/163 R, 165, 170, 168

[56] References Cited

U.S. PATENT DOCUMENTS

| | | | |
|---|---|---|---|
| 675,024 | 5/1901 | Sonntag | 101/351 |
| 1,894,966 | 1/1933 | Webern et al. | 101/351 |
| 2,018,282 | 10/1935 | Robinson | 101/247 |
| 3,064,564 | 11/1962 | Lindemann | 101/351 |
| 3,191,529 | 6/1965 | Barthel | 101/184 |
| 3,715,979 | 2/1973 | Erb et al. | 101/148 |
| 4,958,558 | 9/1990 | Harreither | 101/170 |
| 5,101,723 | 4/1992 | Holl et al. | 101/148 |

FOREIGN PATENT DOCUMENTS

| | | | |
|---|---|---|---|
| 415382 | 6/1925 | Germany . | |
| 21207 | 9/1900 | United Kingdom . | |
| 441488 | 7/1934 | United Kingdom | 101/153 |

*Primary Examiner*—Edgar S. Burr
*Assistant Examiner*—Amanda B. Sandusky
*Attorney, Agent, or Firm*—Leydig, Voit & Mayer, Ltd.

[57] ABSTRACT

To improve the throw-on and throw-off movement of the rollers in the roller train of inking or dampening units of a printing machine, an improved and simpler throw-on and throw-off device is provided. For this purpose, intermediate rollers are carried in bearing levers, which enable the intermediate rollers to be thrown off from adjacent distributor rollers. For the simple parallel throw-on of the intermediate rollers, their bearing levers carry cam rollers which are supported on an adjusting rod. The adjusting rod has cam sections which cooperate with the cam rollers, and in response to longitudinal displacement of the adjusting rod, the intermediate rollers are moveable in throw-on and throw-off directions.

19 Claims, 2 Drawing Sheets

DEVICE FOR THE THROW-ON AND THROW-OFF OF ROLLERS

FIELD OF THE INVENTION

The present invention relates to a device for the throw-on and throw-off of rollers in a printing press.

BACKGROUND OF THE INVENTION

In inking and dampening units of printing presses, it is necessary for rollers to be thrown on and off relative to the rollers cooperating with them. This is done, for example, when the transport of printing ink or dampening medium has to be interrupted. It is known, for this purpose, to mount the rollers on bearing levers, which are pivotable about an axis, and to throw them on or off relative to the adjacent rollers or printing-unit cylinders by means of adjusting cams or cam rollers which are mounted on control shafts and engage the bearing levers. In known devices, the adjusting cams or cam rollers are arranged on a rotary shaft which is parallel to the rollers. During rotation of the shaft, the adjusting cams are brought into engagement with corresponding operative surfaces on the roller levers and bring about their displacement. At the same time, torsional forces act on the adjusting shaft and can generate irregular throw-on and throw-off movement of the rollers as a result of torsional deflection of the shaft. For this reason, irregular throw-on of the rollers may occur, as seen over the length of the rollers.

OBJECTS AND SUMMARY OF THE INVENTION

It is an object of the invention to provide a device for the throw-on and throw-off of rollers which works in a torsion-free manner.

Another object is to provide a throw-off device as characterized above which allows for a regular throw-on and throw-off of rollers.

A further object is to provide a throw-off device of the above kind which is relatively simple in construction and operation and lends itself to economical manufacture.

Other objects and advantages of the invention will become apparent upon reading the following detailed description and upon reference to the drawings, in which:

Figure 1:
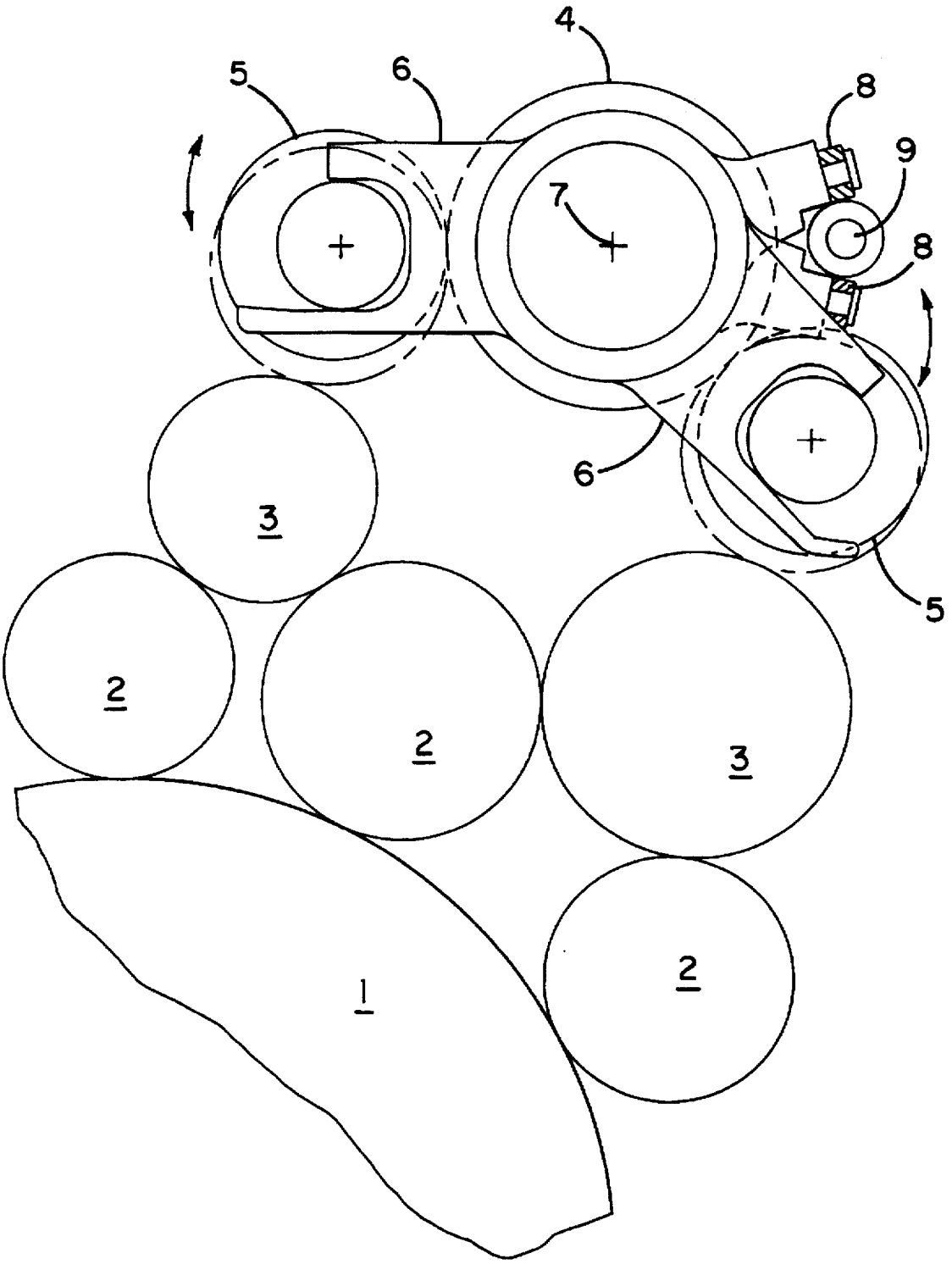
FIG. 1 is a side elevational view of a printing press inking unit having a roller throw-off device in accordance with the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE DRAWINGS

Referring now more particularly to FIG. 1 of the drawings, there is shown an inking unit of a printing press having a roller throw-off device in accordance with the present invention. The illustrated inking unit includes a plurality of applicator rollers 2 mounted in rolling contact with the surface of a plate cylinder 1. Distributor rollers 3 are in contact with opposite sides of the applicator rollers 2, and a pair of intermediate rollers 5 are arranged between a further distributor roller 4 and the distributor rollers 3. Each intermediate roller 5 is supported by a bearing lever 6 at its opposite ends, with the bearing levers each being mounted for pivotal movement about an axis 7 of the distributor roller 4 and biased in the direction of the distributor rollers 3, 4 by known means. To facilitate pivotal movement of the bearing levers 6, each bearing lever 6 carries a cam roller 8.

In accordance with the invention, linearly movable adjusting means is arranged parallel to the axis of the rollers and is operable for pivoting the bearing lever rolling holding means and the rollers supported thereon between throw-on and throw-off positions in response to linear movement of the adjusting means in a direction parallel to the axes of the rollers. More particularly, the adjusting means is operable for pivoting the bearing lever roller holding means and the rollers supported thereby in a throw-off direction in response to movement of the adjusting means in one linear direction parallel to the axis of the rollers and is operable for pivoting the holding means and the rollers supported thereby in a throw-on direction in response to linear movement of the adjusting means in an opposite linear direction parallel to the axis of the rollers. To this end, in the illustrated embodiment, the adjusting means includes an elongated adjusting rod 9 having a plurality of cam sections 10 which are operable for radially moving the cam rollers 8 and bearing levers 6 for the intermediate rollers 5 in response to linear movement of the adjusting rod 9 in the longitudinal direction of the adjusting rod.

For supporting the adjusting rod 9 for longitudinal movement, the ends of the rod are supported in bearing sleeves 12 mounted in a frame 13 of the inking unit. For effecting longitudinal movement of the adjusting rod 9, a drive 11 is provided at one end of the adjusting rod 9. The drive 11 can be a small pneumatic cylinder or the like mounted outside the frame 13, with the adjusting rod 9 effectively being a piston of the cylinder which is movable upon actuation of the cylinder relative to the bearing sleeves 12 and frame 13.

Figure 2:
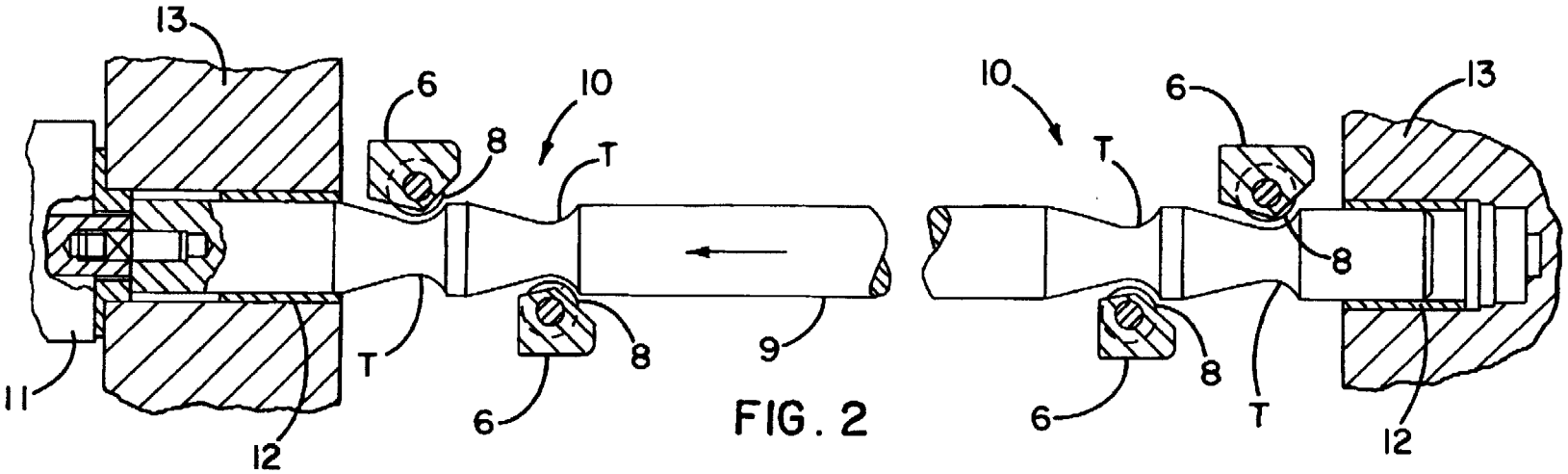
FIG. 2 is a fragmentary section of the linearly movable adjusting rod of the illustrated roller throw-off device showing the rod in a first position.
Figure 3:
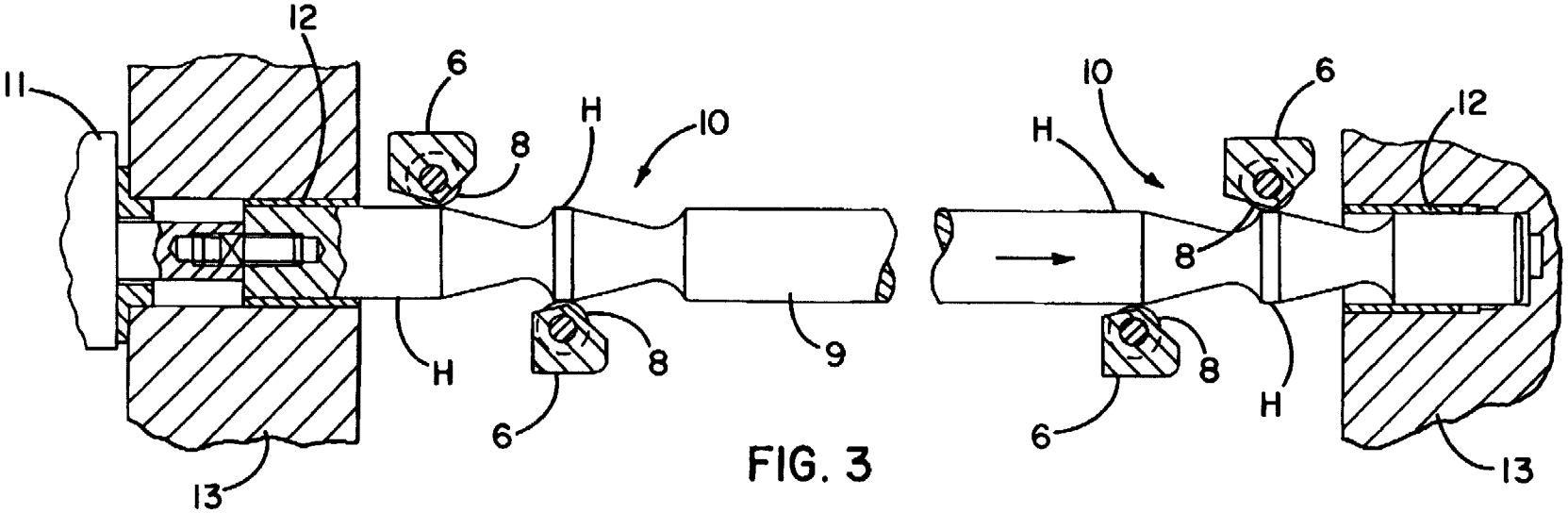
FIG. 3 is a fragmentary section, similar to FIG. 2, showing the adjusting rod in a second position.

The cam sections 10 of the adjusting rod 9, on the one hand, have high positions H upon which the cam rollers 8 are at a high point and low positions T where the cam rollers are at a low point. As shown in FIG. 2, the cam rollers 8 each are in the low position T, and in this position, the intermediate rollers are thrown onto the distributor rollers 3 and 4 through actuation of the respective bearing levers 6 for the distributor intermediate rollers 5. To throw off the intermediate rollers 5, the adjusting rod 9 is linearly moveable in a longitudinal direction upon actuation of the drive 11. As shown in FIG. 3, the adjusting rod is displaced to the throw-off position with the cam rollers 8 of the bearing levers 6 for the intermediate rollers being moved to high positions H on the adjusting rod.

It will be appreciated that since the adjusting rod is longitudinally moveable during such throw-on and throw-off movement, torsional bending and deflection of the bending rod will not occur. Moreover, the adjusting forces bear symmetrically on the adjusting rod 9 and therefore do not generate any other irregular loads on the adjusting rod. This ensures that the bearing levers 6, which are arranged in pairs, operate in exactly identical manner and consequently the corresponding intermediate rollers 5 coupled to the bearing lever 6 are adjusted and thrown on and off simultaneously.

It will be further appreciated that the device is relatively simple in construction and operation, with throw-on and throw-off movement of both intermediate rollers 5 being controlled by a common adjusting rod 9. Consequently,. since the cam rollers 8 for the bearing levers 6 of both intermediate rollers 5 cooperate with and are controlled by a common adjusting rod 9 from opposite sides thereof forces on the adjusting rod tend to counteract each other, further providing for stability and regularity in the throw-off movement. It will seen that specific cam configurations 10 can be provided for each roller so that different conditions of throw-off on the roller could be controlled separately if desired. Since the adjusting rods 9 are designed as rotationally symmetrical parts, a relatively simple relationship of the cam rollers 8 to the adjusting rods 9 is possible. There is no need for an adjustment of the cam sections 10 in relation to the cam rollers 8, nor is there any appreciable deflection of the adjusting rod during throw-off and throw-on and of the intermediate rollers 5 which causes adverse operating effects.

From the foregoing, it can be seen that the throw-on and throw-off device for the roller works in a substantially torsional-free manner, allowing for regular and reliable operation. The throw-off device, furthermore, is relatively simple in construction and lends itself to economical manufacture and reliable operation.

What is claimed is:

1. A printing press comprising a plurality of rollers disposed in parallel relation to each other, at least one of said rollers being mounted for pivotal movement between throw-on and throw-off positions with respect to other of said rollers, a pivot member rotatably supporting said one roller, said pivot member being mounted for pivotal movement, an adjusting rod disposed in parallel relation to the axis of said rollers, said pivot member having a follower portion biased into engagement with said adjusting rod, said adjusting rod being linearly moveable in a direction parallel to the axis of said rollers, and said pivot member and one roller supported thereby being pivotal between throw-on and throw-off positions with respect to said other rollers in response to linear movement of said adjusting rod.

2. The printing press of claim 1 in which said adjusting rod is moveable in one linear direction parallel to the axis of said rollers for pivoting the pivot member and one roller in a throw-on direction and is moveable in an opposite linear direction parallel to the axis of said rollers for pivoting the pivot member and one roller in a throw-off direction.

3. The printing press of claim 2 in which said adjusting rod has cam sections.

4. The printing press of claim 3 in which said cam sections are annular in configuration.

5. The printing press of claim 4 in which said adjusting rod is rotationally symmetrical.

6. The printing press of claim 5 including a drive for axially moving the adjusting rod.

7. The printing press of claim 1 in which said pivot member has a cam roller on the follower portion thereof.

8. The printing press of claim 1 in which two of said rollers are mounted for pivotal movement between throw-on and throw-off position with respect to other of said rollers, said two rollers each being rotatably mounted on a respective pivot member, said pivot members each having a follower portion biased into engagement with said actuating rod, and said adjusting rod being linearly moveable in a direction parallel to the axis of said rollers for moving said pivot members and two rollers supported thereby between throw-on and throw-off positions.

9. The printing press of claim 8 in which said adjusting rod has a plurality of cam sections each designed for actuating a pivot member for a respective one of said two rollers.

10. A printing press comprising rollers in parallel relation to each other, a plurality of said rollers being mounted for throw-on and throw-off movement with respect to other of said rollers, said plurality of rollers each having a respective holder for rotatably supporting the roller, said holder for each of said plurality of said rollers being moveable for moving the respective roller supported thereby between throw-on and throw-off positions relative to said other rollers, and a single linearly moveable adjusting device arranged parallel to the axis of said rollers and being operable for moving said holders and the rollers supported thereby between throw-on and throw-off positions in response to linear movement of said adjusting device in a direction parallel to the axis of said rollers.

11. In the printing press of claim 10 in which each holder includes a lever arm, and said lever arms for said plurality of rollers each being pivotally mounted about a common axis.

12. In the printing press of claim 10 in which said plurality of rollers consists of two rollers, said holders for said two rollers each having a lever arm, and said adjusting rod being disposed between said lever arms.

13. In the printing press of claim 12 in which said lever arms are mounted for pivotal movement about an axis of one of said other rollers.

14. In the printing press of claim 10 in which said adjusting device is operable for pivotally moving the holders of said plurality of rollers and the rollers supported thereby in a throw-off direction upon movement in one linear direction parallel to the axes of said rollers and pivotally moving said holders and the rollers supported thereby in a throw-on direction in response to movement in an opposite linear direction parallel to the axes of said rollers.

15. In the printing press of claim 14 in which said adjusting device includes an elongated adjusting rod disposed parallel to said rollers, said adjusting rod having cam sections, and a drive for selectively moving said adjusting rod in the direction of the longitudinal axis of said adjusting rod.

16. In the printing press of claim 15 in which said plurality of rollers each has at least one cam follower roller contacting said adjusting rod, and said cam rollers are radially moveable with respect to the adjusting rod in response to linear movement of said adjusting rod.

17. In the printing press of claim 16 in which said plurality of rollers each have cam rollers at their opposite ends contacting said adjusting rod.

18. A printing press comprising a plate cylinder, a pair of distributor rollers, a pair of intermediate rollers for engagement with said distributor rollers, and a further distributor roller for engagement with the intermediate rollers, said intermediate rollers each being rotatably supported by a bearing lever, said bearing levers each being mounted for pivotal movement with respect to a common axis, and a throw-on and throw-off adjusting device arranged parallel to the axis of said rollers and being operable for pivoting said bearing levers and the intermediate rollers supported thereby between throw-off and throw-on portions with respect to said pair of distributor rollers in response to linear movement of said adjusting device in a direction parallel to the axis of said rollers.

19. The printing press of claim 18 in which said bearing levers each are mounted for pivotal movement about the axis of said further distributor roller.

* * * * *